US005131828A

United States Patent [19]

Richardson, Jr. et al.

[11] Patent Number: 5,131,828

[45] Date of Patent: Jul. 21, 1992

[54] SCROLL COMPRESSOR INCLUDING COMPLIANCE MECHANISM FOR THE ORBITING SCROLL MEMBER

[75] Inventors: Hubert Richardson, Jr., Brooklyn; George W. Gatecliff, Saline, both of Mich.

[73] Assignee: Tecumseh Products Company, Tecumseh, Mich.

[21] Appl. No.: 675,641

[22] Filed: Mar. 27, 1991

[51] Int. Cl.[5] ..... F04C 18/04; F04C 29/02

[52] U.S. Cl. ..... 418/55.3; 418/55.4; 418/55.5; 418/55.6; 418/57; 418/151

[58] Field of Search ..... 418/55.3, 55.4, 55.5, 418/55.6, 57, 94, 151

[56] References Cited

U.S. PATENT DOCUMENTS

| | | | |
|---|---|---|---|
| 4,350,479 | 9/1982 | Tojo et al. | 418/55.6 |
| 4,522,575 | 6/1985 | Tischer et al. | 418/55.5 |
| 4,762,477 | 8/1988 | Hayano et al. | 418/94 |
| 4,767,293 | 8/1988 | Caillat et al. | 418/55.5 |
| 4,875,838 | 10/1989 | Richardson, Jr. | 418/55.5 |
| 4,884,955 | 12/1989 | Richardson, Jr. | 418/1 |
| 4,997,349 | 3/1991 | Richardson, Jr. | 418/55.5 |

*Primary Examiner*—John J. Vrablik

*Attorney, Agent, or Firm*—Baker & Daniels

[57] ABSTRACT

A hermetic scroll-type compressor including a housing, fixed and orbiting scroll members, a frame member having a thrust surface adjacent the orbiting scroll member back surface, and a crankshaft coupled to the orbiting scroll member. A seal between the thrust surface and the back surface of the orbiting scroll member seals between a radially inner portion of the back surface exposed to discharge pressure and a radially outer portion exposed to suction pressure. The frame member defines an annular oil chamber having a side surface and a bottom surface above which the radially outer portion of the back surface orbits in spaced relationship. The oil-chamber contains a sufficient depth of oil between the bottom surface and the back surface, whereby the oil exerts a reaction force on the back surface in response to rotating inclined wobbling motion of the orbiting scroll member.

24 Claims, 5 Drawing Sheets

SCROLL COMPRESSOR INCLUDING COMPLIANCE MECHANISM FOR THE ORBITING SCROLL MEMBER

BACKGROUND OF THE INVENTION

The present invention relates generally to a hermetic scroll-type compressor including intermeshing fixed and orbiting scroll members and, more particularly, to such a compressor having a compliance mechanism that acts on the orbiting scroll member to bias it toward the fixed scroll member for proper mating and sealing therebetween.

A typical scroll compressor comprises two facing scroll members, each having an involute wrap, wherein the respective wraps interfit to define a plurality of closed compression pockets. When one of the scroll members is orbited relative to the other, the pockets decrease in volume as they travel between a radially outer suction port and a radially inner discharge port, thereby conveying and compressing the refrigerant fluid.

It is generally believed that the scroll-type compressor could potentially offer quiet, efficient, and low-maintenance operation in a variety of refrigeration system applications. However, several design problems persist that have prevented the scroll compressor from achieving wide market acceptance and commercial success. For instance, during compressor operation, the pressure of compressed refrigerant at the interface between the scroll members tends to force the scroll members axially apart. Axial separation of the scroll members causes the closed pockets to leak at the interface between the wrap tips of one scroll member and the face surface of the opposite scroll member. Such leakage causes reduced compressor operating efficiency and, in extreme cases, can result in an inability of the compressor to operate.

Leakage at the tip-to-face interface between scroll members during compressor operation can also be caused by a tilting and/or wobbling motion of the orbiting scroll member. This tilting motion is the result of overturning moments generated by forces acting on the orbiting scroll at axially spaced locations thereof. Specifically, the drive force imparted by the crankshaft to the drive hub of the orbiting scroll is spaced axially from forces acting on the scroll wrap due to pressure, inertia, and friction. The overturning moment acting on the orbiting scroll member causes it to orbit in a slightly tilted condition so that the lower surface of the plate portion of the orbiting scroll is inclined upwardly in the direction of the orbiting motion. Wobbling motion of the orbiting scroll may result from the interaction between convex mating surfaces, particularly during the initial run-in period of the compressor. For instance, the mating wrap tip surface of one scroll member and face plate of the other scroll member may exhibit respective convex shapes due to machining variations and/or pressure and heat distortion during compressor operation. This creates a high contact point between the scroll members, about which the orbiting scroll has a tendency to wobble until the parts wear in. The wobbling perturbation occurs on top of the tilted orbiting motion described above.

Efforts to counteract the separating force applied to the scroll members during compressor operation, and thereby minimize the aforementioned leakage, have resulted in the development of a variety of prior art axial compliance schemes. In a compressor in which the back side of the orbiting scroll member is exposed to suction pressure, it is known to axially preload the scroll members toward each other with a force sufficient to resist the dynamic separating force. However, this approach results in high initial frictional forces between the scroll members and/or bearings when the compressor is at rest, thereby causing difficulty during compressor startup and subsequent increased power consumption. Another approach is to assure close manufacturing tolerances for component parts and have the separating force borne by a thrust bearing or surface. This requires an expensive thrust bearing, and involves high manufacturing costs in maintaining close machining tolerances.

In a compressor having a pressurized, or "high side", housing, discharge pressure has been used on the back side of the orbiting scroll member to create a compliance force to oppose the separating force. Problems associated with this arrangement include too great an upward force on the orbiting scroll member, thereby promoting rapid wear of the scroll wraps and faces and associated power losses.

In recognition of the aforementioned problems associated with axial compliance mechanisms using either suction pressure or discharge pressure, several prior art compressor designs have utilized a combination of gaseous refrigerant at suction pressure and gaseous refrigerant at discharge pressure. For instance, it is known to expose respective areas on the backside of an axially movable fixed or orbiting scroll member to the two different pressures in order to achieve a net desired force. In such compressor designs, various seal means are utilized to separate the respective gaseous pressure regions and to compensate for axial movement of the scroll member.

In another type of axial compliance mechanism, an intermediate pressure chamber is provided behind the orbiting scroll member, whereby the intermediate pressure creates an upward force to oppose the separating force. Such a design recognizes the problems associated with the use of suction pressure or discharge pressure alone, and obviates the need for sealing between respective areas of each. Such a leak results in less efficient operating conditions for the compressor.

Still another axial compliance mechanism for a scroll compressor involves exposing a radially inner portion of the orbiting scroll member bottom surface to oil at discharge pressure, and a radially outer portion to refrigerant fluid at suction pressure. The regions are sealingly separated by a flexible annular seal element that is disposed between the orbiting scroll member bottom surface and a rotating thrust surface comprising a radially extending plate portion of a driven crankshaft.

The present invention is directed to overcoming the aforementioned problems associated with scroll-type compressors, wherein it is desired to provide an axial compliance mechanism that helps to prevent leakage between the interfitting scroll members caused by axial separation therebetween and wobbling/tilting motion of the orbiting scroll member.

SUMMARY OF THE INVENTION

The present invention overcomes the disadvantages of the above-described prior art scroll-type compressors by providing an improved axial compliance mechanism that resists both the tendency of the scroll members to axially separate and the tendency of the orbiting scroll member to wobble/tilt during compressor operation.

Generally, the invention provides a scroll-type compressor including a fixed scroll member and an orbiting scroll member that are biased toward one another by an axial compliance mechanism. The drive mechanism by which the orbiting scroll member is orbited relative the fixed scroll member has a tendency to cause a tilting and wobbling motion of the orbiting scroll member during compressor operation. The axial compliance mechanism involves the application of discharge pressure to a radially inner portion of the back surface of the orbiting scroll member and suction pressure to a radially outer portion of the back surface. Furthermore, an oil pool is provided adjacent the radially outer portion of the back surface of the orbiting scroll member, whereby a reactionary force is exerted by the oil upon the back surface in response to the rotating inclined and wobbling motion of the orbiting scroll member.

More specifically, the invention provides an axial compliance mechanism that exerts both an active force on the orbiting scroll member to counteract the separation force between the scroll members caused by the compression pockets, and a reactive force on the radially outer portion of the back surface of the orbiting scroll member to counteract the rotating inclined and wobbling motion of the orbiting scroll member. The active force is constantly applied to the orbiting scroll member by exposure of a combination of discharge pressure and suction pressure to respective areas on the back surface of the orbiting scroll member. The reactive force is exerted by a wedge-shaped pool of oil adjacent the radially outer portion of the back surface of the orbiting scroll member in response to the rotating inclined and wobble perturbation motion of the orbiting scroll member. Because the orbiting scroll is tilted slightly, there can be a widened gap between the seal and the thrust surface, thereby permitting a stream of oil to be pumped into the wedge-shaped pool of oil, which assists in maintaining the wedge-shaped pool of oil sufficiently deep to provide the reaction forces against the induced wobbling and tilting forces. The effect of the tilted scroll and the pumping of oil into the oil pool can be analogized to a round disk being towed behind a boat that is moving in a tight circle. The disk will tend to be inclined backwardly away from the direction of motion, thereby creating a "wedge" of water in front of the lower inclined surface of the disk. The pumping action caused by the widened rotating seal gap can be likened to a stream of water being sprayed into the wedge-shaped cushion of water by means of a hose. It is this wedge of oil that provides the reaction forces against the wobbling/tilting motion of the orbiting scroll. The reaction forces tend to dampen out the wobbling perturbations and provide better axial and radial compliance.

The invention further resides in the recognition that axial separation of the scroll members caused by rotating overturning moments acting on the orbiting scroll member can be effectively resisted without increasing the static pressure force exerted on the orbiting scroll for the purpose of counteracting the separating force between the scroll members, thereby minimizing frictional forces and associated power losses in the compressor. 10 This is accomplished by providing a mechanism whereby a reactive force exerted on the orbiting scroll member is not dependent on static pressure levels, but rather on the rotating inclined/wobbling motion itself. Accordingly, the oil pool that exerts the reactionary force in accordance with the present invention can be situated within a suction pressure region.

In accordance with a further aspect of one form of the invention, an Oldham ring for preventing rotation of the orbiting scroll member is disposed intermediate the back surface of the scroll member and the bottom surface of an annular oil chamber defining an oil pool. During orbiting motion of the scroll member, the Oldham ring experiences reciprocating movement within the oil pool relative the orbiting scroll member and frame member, thereby causing localized hydraulic pressurization of the oil at the boundaries of the Oldham ring, thereby providing an additional localized axial force on the orbiting scroll member to counteract the wobbling/tilting motion.

An advantage of the scroll-type compressor of the present invention is the provision of an axial compliance mechanism that resists axial separation of the scroll members caused by both separating forces and overturning moments applied to the orbiting scroll member.

Another advantage of the scroll-type compressor of the present invention is that wobbling motion of the orbiting scroll member is effectively minimized without increasing the constantly applied axial compliance force, thereby improving sealing properties while minimizing power consumption.

A further advantage of the scroll-type compressor of the present invention is that wobbling of the orbiting scroll member during the initial run-in stage of the compressor is minimized, thereby enabling the scroll members to wear in more quickly. After run-in, the small remaining wobble perturbations further reduce sealing friction.

Yet another advantage of the scroll-type compressor of the present invention is the provision of a mechanism for counteracting the rotating inclined wobbling motion of the orbiting scroll member that functions independently of static pressure levels utilized for counteracting the separating forces between the scroll members.

A still further advantage of the scroll compressor of the present invention is the provision of a simple, reliable, inexpensive, and easily manufactured compliance mechanism for producing a constantly applied force on the orbiting scroll plate toward the fixed scroll member, and for producing a reactionary force in response to wobbling/tilting motion of the orbiting scroll member.

The scroll compressor of the present invention, in one form thereof, provides a hermetic scroll-type compressor including a housing having a discharge pressure chamber at discharge pressure and a suction pressure chamber at suction pressure. Within the housing are fixed and orbiting scroll members having respective wraps that are operably intermeshed to define compression pockets therebetween. A crankshaft is drivingly coupled to the orbiting scroll member at a location spaced axially from the intermeshed wraps, thereby causing the orbiting scroll member to orbit relative to the fixed scroll member. A radially inner portion of a back surface of the orbiting scroll member is exposed to the discharge pressure chamber, and a radially outer portion of the back surface is exposed to the suction pressure chamber, thereby exerting an axial compliance force on the orbiting scroll member toward the fixed scroll member. The drive force exerted on the orbiting scroll member is at a location spaced axially from the intermeshed wraps, thereby causing the orbiting scroll member to experience an overturning moment that results in a rotating inclined motion of the orbiting scroll member. A mechanism is provided whereby a 10 reactionary force is applied to the radially outer portion of the back surface in response to wobbling/tilting motion of the orbiting scroll member, thereby counteracting the wobbling/tilting motion and improving sealing between the fixed and orbiting scroll members. The mechanism involves an oil pool that is defined by an annular oil chamber having a bottom surface above which the radially outer portion of the back surface of the orbiting scroll member orbits in spaced relationship therewith. The back surface of the orbiting member is sufficiently large and the chamber is provided with oil of a sufficient depth to effectively fill the space between the bottom surface of the oil chamber and the back surface of the orbiting scroll member to cause application of a force to the back surface by the oil when the angular inclination of the orbiting scroll member wobbles and reduces the space between the bottom surface and the back surface.

DESCRIPTION OF THE PREFERRED EMBODIMENT

Figure 1:
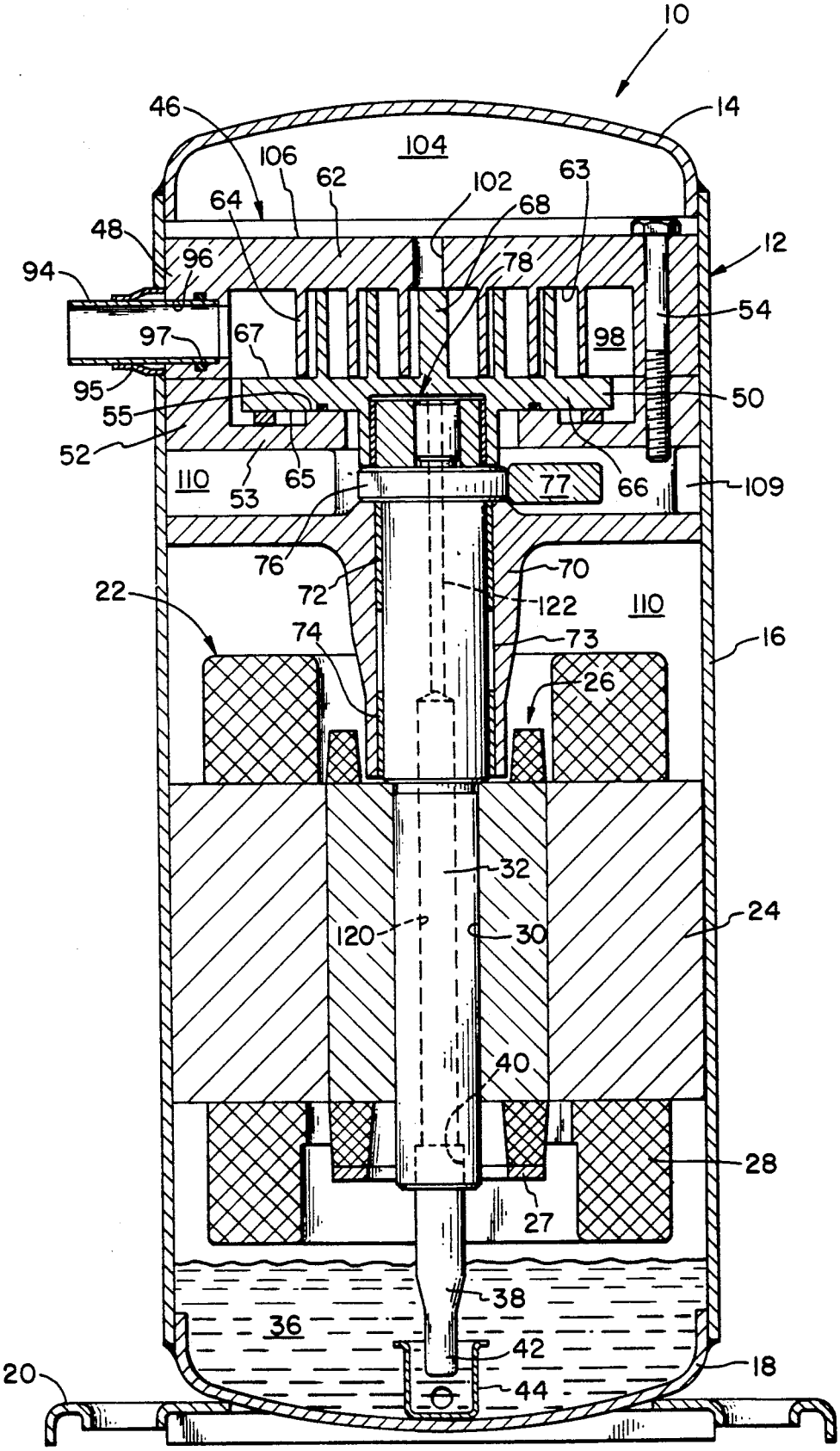
FIG. 1 is a longitudinal sectional view of a compressor of the type to which the present invention pertains, taken along the line 1—1 in FIG. 4 and viewed in the direction of the arrows.
Figure 6:
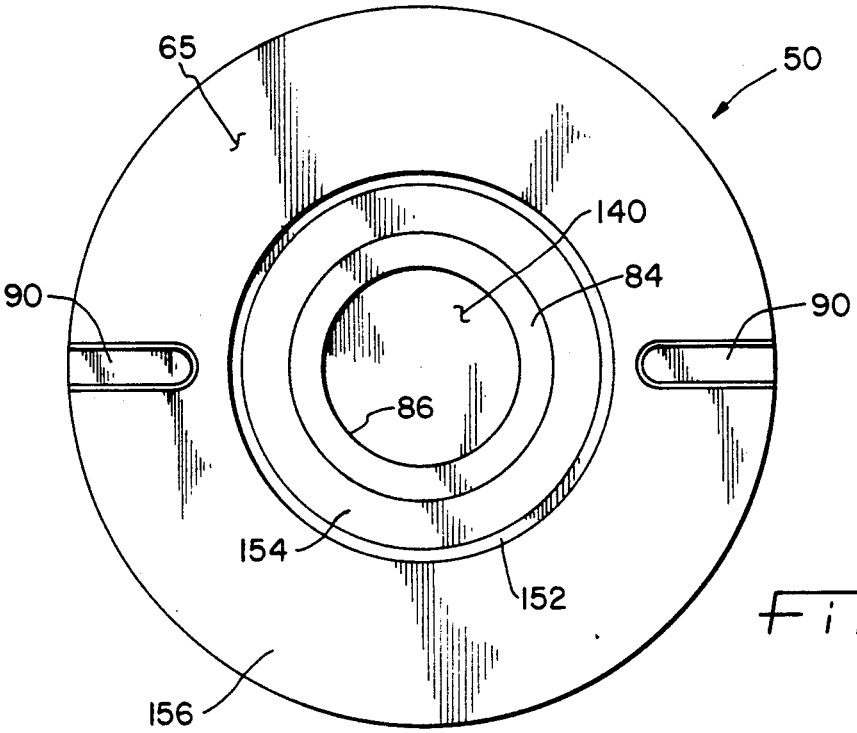
FIG. 6 is an enlarged bottom view of the orbiting scroll member of the compressor of FIG. 1.
Figure 2:
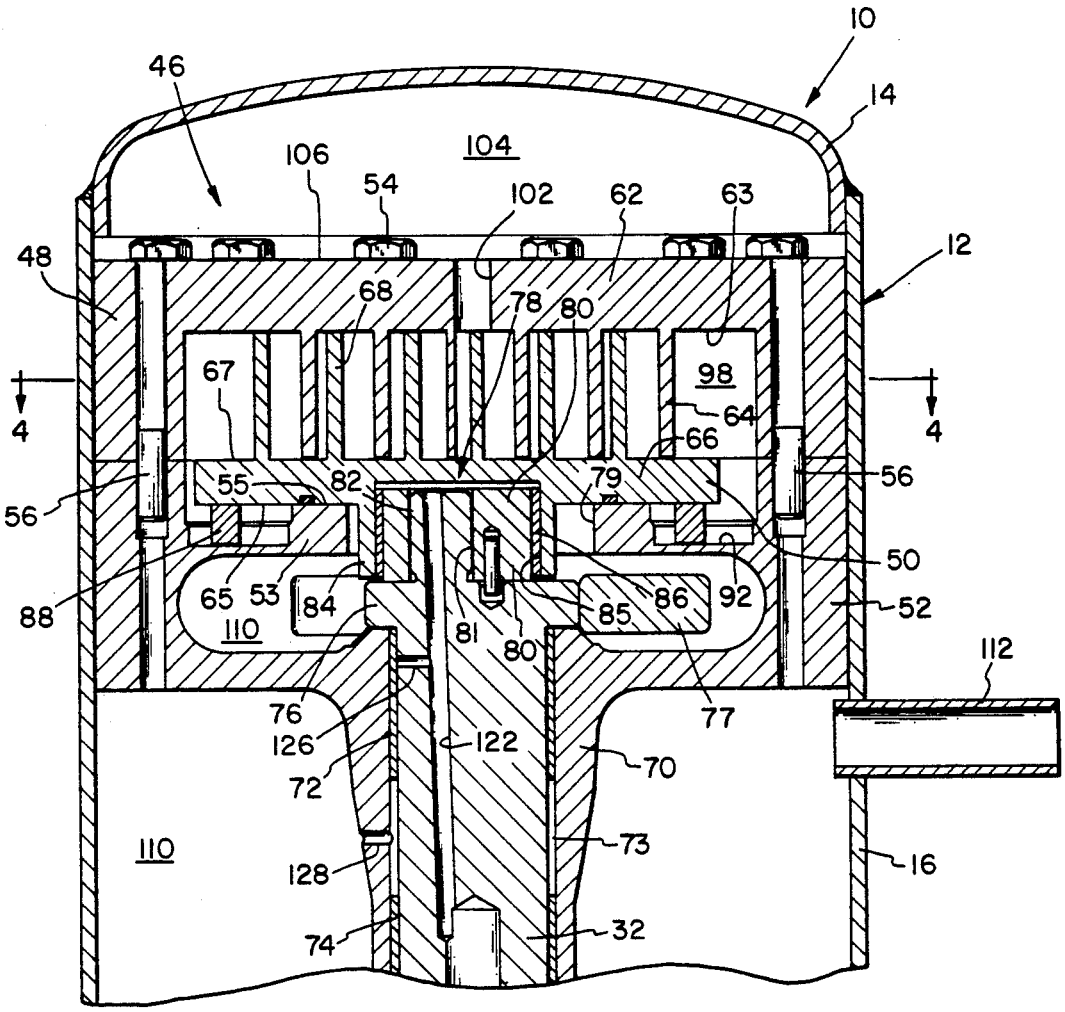
FIG. 2 is an enlarged fragmentary sectional view of the compressor of FIG. 1, taken along the line 2—2 in FIG. 4 and viewed in the direction of the arrows.

In an exemplary embodiment of the invention as shown in the drawings, and in particular by referring to FIGS. 1 and 2, a compressor 10 is shown having a housing generally designated at 12. This embodiment is only provided as an example and the invention is not limited thereto. The housing has a top cover portion 14, a central portion 16, and a bottom portion 18, wherein central portion 16 and bottom portion 18 may alternatively comprise a unitary shell member. The three housing portions are hermetically secured together as by welding or brazing. A mounting flange 20 is welded to bottom portion 18 for mounting the compressor in a vertically upright position. Located within hermetically sealed housing 12 is an electric motor generally designed at 22, having a stator 24 and a rotor 26. Stator 24 is secured within central portion 16 of the housing by an interference fit such as by shrink fitting, and is provided with windings 28. Rotor 26 has a central aperture 30 provided therein into which is secured a crankshaft 32 by an interference fit. The rotor also includes a counterweight 27 at the lower end ring thereof. A terminal cluster 34 (FIG. 4) is provided in central portion 16 of housing 12 for connecting motor 22 to a source of electric power.

Compressor 10 also includes an oil sump 36 generally located in bottom portion 18. A centrifugal oil pickup tube 38 is press fit into a counterbore 40 in the lower end of crankshaft 32. Oil pickup tube 38 is of conventional construction and includes a vertical paddle (not shown) enclosed therein. An oil inlet end 42 of pickup tube 38 extends downwardly into the open end of a cylindrical oil cup 44, which provides a quiet zone from which high quality, non-agitated oil is drawn.

Compressor 10 includes a scroll compressor mechanism 46 enclosed within housing 12. Compressor mechanism 46 generally comprises a fixed scroll member 48, an orbiting scroll member 50, and a main bearing frame member 52. As shown in FIG. 1, fixed scroll member 48 and frame member 52 are secured together by means of a plurality of mounting bolts 54. Precise alignment between fixed scroll member 48 and frame member 52 is accomplished by a pair of locating pins 56. Frame member 52 is mounted within central portion 16 of housing 12 by means of a plurality of circumferentially disposed mounting pins (not shown) of the type shown and described in assignee's U.S. Pat. No. 4,846,635, the disclosure of which is hereby incorporated herein by reference. The mounting pins facilitate mounting of frame member 52 such that there is an annular gap between stator 24 and rotor 26.

Fixed scroll member 48 comprises a generally flat face plate 62 having a face surface 63, and an involute fixed wrap 64 extending axially from surface 63. Likewise, orbiting scroll member 50 comprises a generally flat face plate 66 having a back surface 65, a top face surface 67, and an involute orbiting wrap 68 extending axially from surface 67. Fixed scroll member 48 and orbiting scroll member 50 are assembled together so that fixed wrap 64 and orbiting wrap 68 operatively interfit with each other. Furthermore, face surfaces 63, 67 and wraps 64,68 are manufactured or machined such that, during compressor operation when the fixed and orbiting scroll members are forced axially toward one another, the tips of wraps 64, 68 sealingly engage with respective opposite face surfaces 67, 63.

Main bearing frame member 52 includes an annular, radially inwardly projecting portion 53, including an axially facing stationary thrust surface 55 ad3acent back surface 65 and in opposing relationship thereto. Back surface 65 and thrust surface 55 lie in substantially parallel planes and are axially spaced according to machining tolerances and the amount of permitted axial compliance movement of orbiting scroll member 50 toward fixed scroll member 48.

Main bearing frame member 52, as shown in FIGS. 1 and 2, further comprises a downwardly extending bearing portion 70. Retained within bearing portion 70, as by press fitting, is a conventional sleeve bearing assembly comprising an upper bearing 72 and a lower bearing 74. Two sleeve bearings are preferred rather than a single longer sleeve bearing to facilitate easy assembly into bearing portion 70 and to provide an annular space 73 between the two bearings 72, 74. Accordingly, crankshaft 32 is rotatably 3ournalled within bearings 72, 74.

Figure 5:
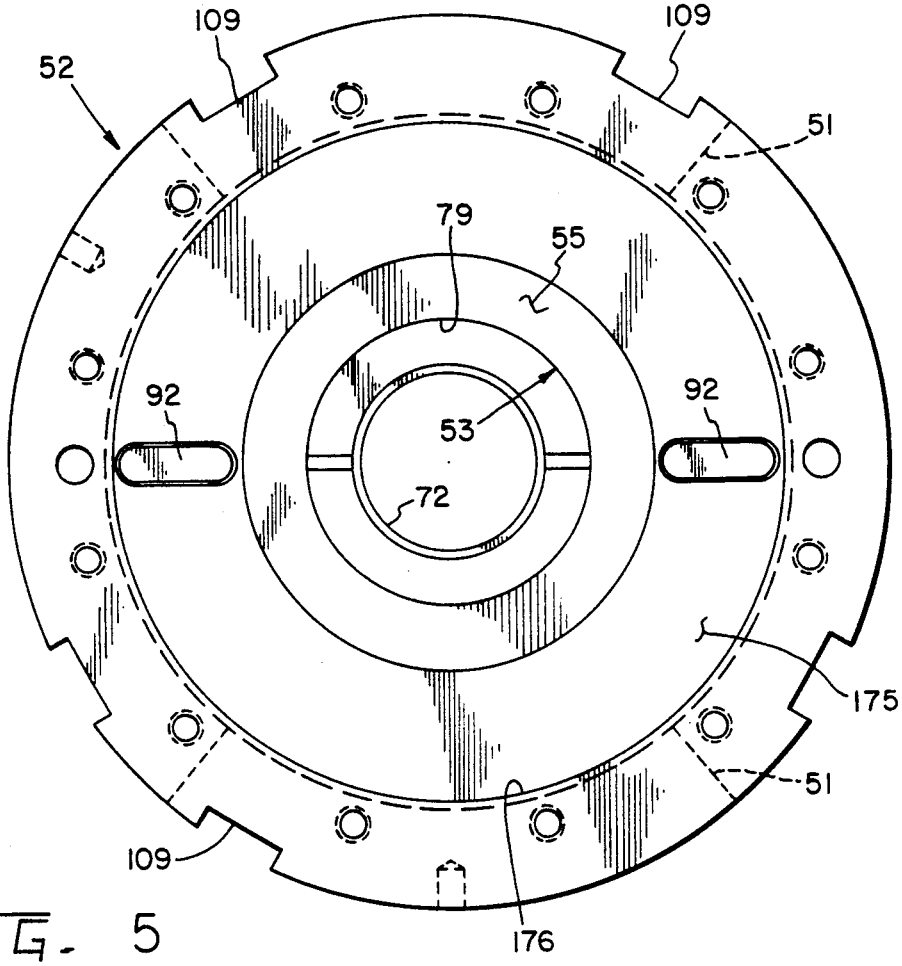
FIG. 5 is an enlarged top view of the main bearing frame member of the compressor of FIG. 1.
Figure 4:
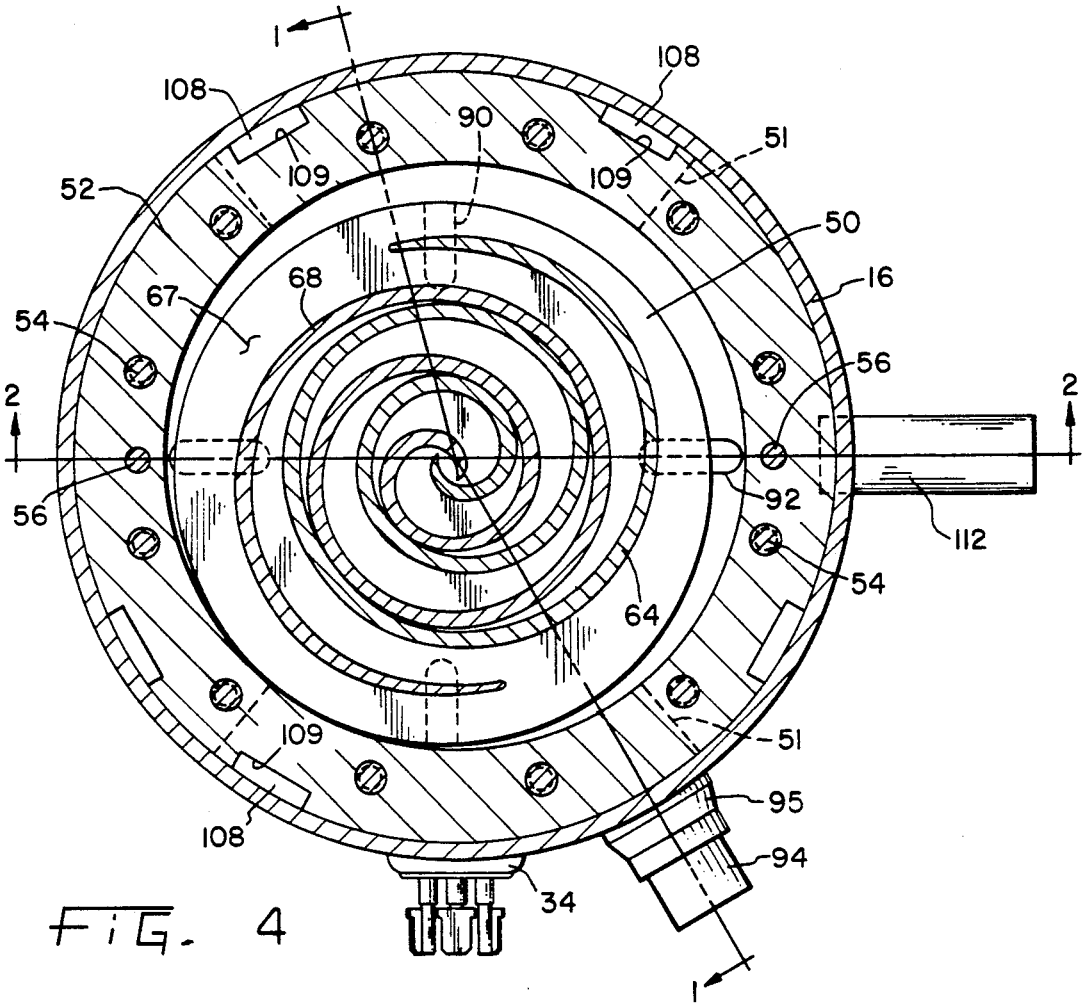
FIG. 4 is an enlarged transverse sectional view of the compressor of FIG. 1, taken along the line 4—4 in FIG. 2 and viewed in the direction of the arrows.

Crankshaft 32 includes a concentric thrust plate 76 extending radially outwardly from the sidewall of crankshaft 32. A balance weight 77 is attached to thrust plate 76, as by bolts 75. In the preferred embodiment disclosed herein, the diameter of thrust plate 76 is less than the diameter of a round opening 79 defined by inwardly projecting portion 53 of frame 52, whereby crankshaft 32 may be inserted downwardly through opening 79. Once crankshaft 32 is in place, balance weight 77 is attached thereto through one of a pair of radially extending mounting holes 51 extending through frame member 52, as shown in FIGS. 4 and 5. This mounting holes also ensures that the space surrounding thrust plate 76 is part of housing chamber 110 at discharge pressure via passages 108 defined by axially extending notches 109 formed in the outer periphery of frame 52.

Figure 3:
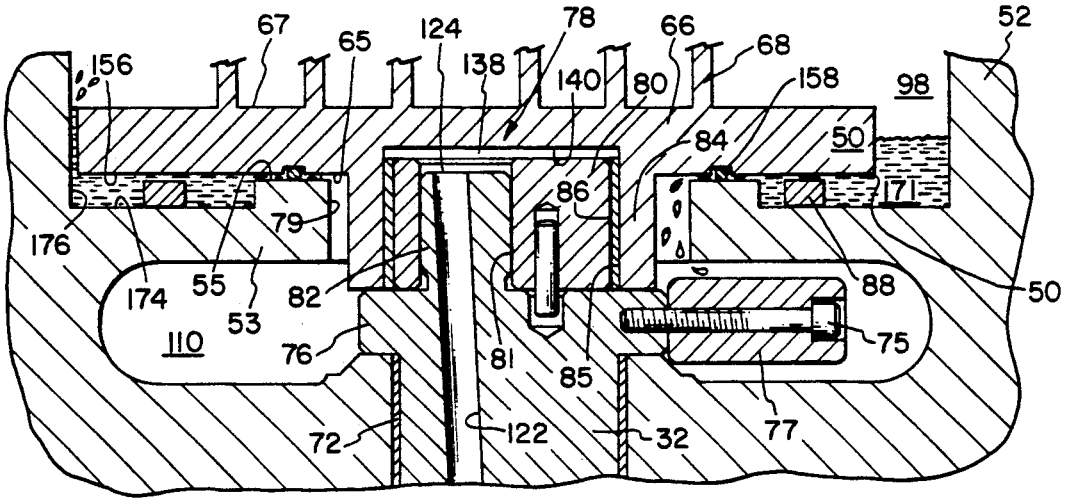
FIG. 3 is an enlarged fragmentary sectional view of the compressor of FIG. 1, particularly showing the orbiting scroll member compliance mechanism of the present invention.

An eccentric crank mechanism 78 is situated on the top of crankshaft 32, as best shown in FIGS. 2 and 3. According to a preferred embodiment, crank mechanism 78 comprises a cylindrical roller 80 having an axial bore 81 extending therethrough at an off-center location. An eccentric crankpin 82, constituting the upper, offset portion of crankshaft 32, is received within bore 81, whereby roller 80 is eccentrically journalled about eccentric crankpin 82. Orbiting scroll member 50 includes a lower hub portion 84 that defines a cylindrical well 85 into which roller 80 is received. Roller 80 is journalled for rotation within well 85 by means of a sleeve bearing 86, which is press fit into well 85. Each of sleeve bearings 72, 74, and 86 is preferably a steel-backed bronze bushing.

When crankshaft 32 is rotated by motor 22, the operation of eccentric crankpin 82 and roller 80 within well 85 causes orbiting scroll member 50 to orbit with respect to fixed scroll member 48. Roller 80 pivots slightly about crankpin 82 so that crank mechanism 78 functions as a conventional swing-link radial compliance mechanism to promote sealing engagement between fixed wrap 64 and orbiting wrap 68. Orbiting scroll member 50 is prevented from rotating about its own axis by means of a conventional Oldham ring assembly, comprising an Oldham ring 88, and Oldham key pairs 90, 92 associated with orbiting scroll member 50 and frame member 52, respectively.

In operation of compressor 10 of the preferred embodiment, refrigerant fluid at suction pressure is introduced through a suction tube 94, which is sealingly received within a counterbore 96 in fixed scroll member 48 with the aid of an 0-ring seal 97. Suction tube 94 is secured to the compressor by means of a suction tube adaptor 95 that is silver soldered or brazed at respective ends to the suction tube opening in the housing. A suction pressure chamber 98 is generally defined by fixed scroll member 48 and frame member 52. Refrigerant is introduced into chamber 98 from suction tube 94 at a radially outer location thereof. As orbiting scroll member 50 is caused to orbit, pressed radially inwardly by moving closed pockets defined by fixed wrap 64 and orbiting wrap 68.

Refrigerant fluid at discharge pressure in the innermost pocket between the wraps is discharged upwardly through a discharge port 102 communicating through face plate 62 of fixed scroll member 48. Compressed refrigerant discharged through port 102 enters a discharge plenum chamber 104 defined by top cover portion 14 and top surface 106 of fixed scroll member 48. Previously described axially extending passages 108 allow the compressed refrigerant in discharge plenum chamber 104 to be introduced into housing chamber 110 defined within housing 12. As shown in FIG. 2, a discharge tube 112 extends through central portion 16 of housing 12 and is sealed thereat as by silver solder. Discharge tube 112 allows pressurized refrigerant within housing chamber 110 to be delivered to the refrigeration system (not shown) in which compressor 10 is incorporated.

Compressor 10 also includes a lubrication system for lubricating the moving parts of the compressor, including the scroll members, crankshaft, and crank mechanism. An axial oil passageway 120 is provided in crankshaft 32, which communicates with tube 38 and extends upwardly along the central axis of crankshaft 32. At a central location along the length of crankshaft 32, an offset, radially divergent oil passageway 122 intersects passageway 120 and extends to an opening 124 on the top of eccentric crankpin 82 at the top of crankshaft 32. As crankshaft 32 rotates, oil pickup tube 38 draws lubricating oil from oil sump 36 and causes oil to move upwardly through oil passageways 120 and 122. Lubrication of upper bearing 72 and lower bearing 74 is accomplished by means of flats (not shown) formed in crankshaft 32, located in the general vicinity of bearings 72 and 74, and communicating with oil passageways 120 and 122 by means of radial passages 126. A vent passage 128 extends through bearing portion 70 to provide communication between annular space 73 and discharge pressure chamber 110.

Referring now to FIG. 3, lubricating oil pumped upwardly through offset oil passageway 122 exits crankshaft 32 through opening 124 located on the top of eccentric crankpin 82. Lubricating oil delivered from hole 124 fills a chamber 138 within well 85, defined by bottom surface 140 of well 85 and the top surf;ace of crank mechanism 78, including roller 80 and crankpin 82. Oil within chamber 138 tends to flow downwardly along the interface between roller 80 and sleeve bearing 86, and the interface between bore 81 and crankpin 82, for lubrication thereof. A flat (not shown) may be provided in the outer cylindrical surfaces of roller 80 and crankpin 82 to enhance lubrication.

Referring now to FIG. 3, lubricating oil at discharge pressure is provided by the aforementioned lubrication system to the central portion of the underside of orbiting scroll member 50 within well 85. Accordingly, when the lubricating oil fills chamber 138, an upward force acts upon orbiting scroll member 50 toward fixed scroll member 48. The magnitude of this upward force, determined by the surface area of bottom surface 140, is insufficient to provide the necessary axial compliance force. Therefore, in order to increase the upward force on orbiting scroll member 50, an annular portion of back surface 65 immediately adjacent, i.e., circumjacent, hub portion 84 is exposed to refrigerant fluid at discharge pressure, as will now be further described.

Compressor 10 includes an axial compliance mechanism characterized by two component forces, the first force being a constantly applied force dependent upon the magnitude of the pressures in discharge pressure chamber 110 and suction pressure chamber 98, and the second force being primarily a reactionary force applied to the orbiting scroll member in response to rotating inclined and wobbling motion caused by overturning moments experienced by the orbiting scroll member due to forces imparted thereto by the drive mechanism.

With regard to the first constantly applied force of the axial compliance mechanism, respective fixed portions of back surface 65 are exposed to discharge and suction pressure, thereby providing a substantially constant force distribution acting upwardly upon orbiting scroll member 50 toward fixed scroll member 48. Consequently, moments about the central axis of orbiting scroll member 50 are minimized. More specifically, an annular seal mechanism 158, cooperating between back surface 65 and adjacent stationary thrust surface 55, sealingly separates between a radially inner portion 154 and a radially outer portion 156 of back surface 65, which are exposed to discharge pressure and suction pressure, respectively. As will be further explained here, seal mechanism 158 includes an annular seal groove 152 formed in back surface 65.

Figure 7:
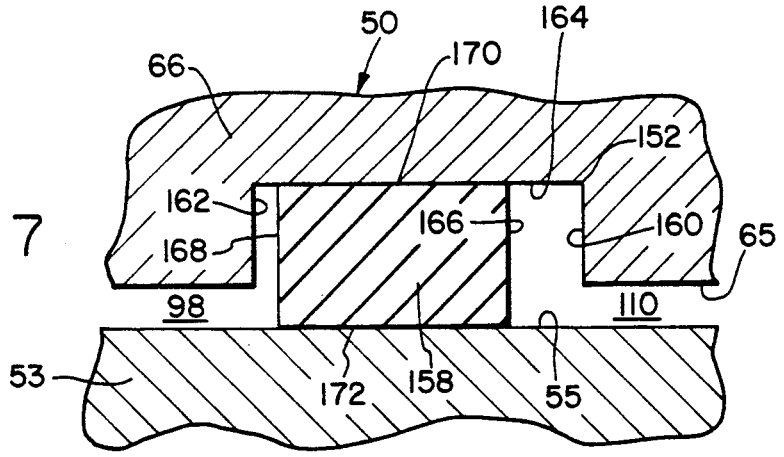
FIG. 7 is an enlarged fragmentary sectional view of the annular seal element of the compressor of FIG. 1, shown in a non-actuated state.
Figure 8:
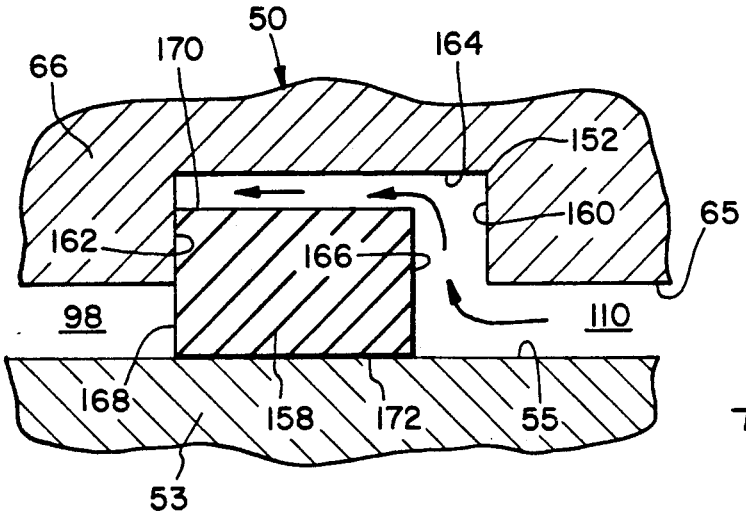
FIG. 8 is an enlarged fragmentary sectional view of the annular seal element of the compressor of FIG. 1, shown in an actuated state.

Referring to FIGS. 7 and 8, the seal mechanism comprises an annular elastomeric seal element 158 unattachedly received within seal groove 152. In the preferred embodiment, the radial thickness of seal element 158 is less than the radial width of seal groove 152, as best shown in FIGS. 7 and 8. Referring to FIG. 7, wherein seal element 158 is shown in an unactuated state when the compressor is off, the axial thickness of seal element 158 is greater than the axial depth of seal groove 152 so as to slightly space back surface 65 from thrust surface 55.

Referring again to FIG. 7, annular seal groove 152 includes a radially inner wall 160, a radially outer wall 162, and a bottom wall 164 extending therebetween. Likewise, annular seal element 158 is generally rectangular and includes a radially inner surface 166, a radially outer surface 168, a top surface 170 and a bottom surface 172. In it's unactuated condition shown in FIG. 7, seal element 158 has a diameter less than the diameter of outer wall 162, whereby outer surface 168 is slightly spaced from outer wall 162.

In operation of compressor 10, axial compliance of orbiting scroll member 50 toward fixed scroll member 48 occurs as the compressor compresses refrigerant fluid for discharge into housing chamber 110. As housing chamber 110 becomes pressurized, discharge pressure occupies the volume shown radially inwardly from inner wall 166 in FIG. 7, thereby causing seal element 158 to expand radially outwardly and scroll member 50 to move axially upwardly away from thrust surface 55, as shown in FIG. 8. As a result of the axial movement of scroll member 50, increased space is created between back surface 65 and thrust surface 55. Seal element 158 moves downwardly toward thrust surface 55 under the influence of gravity and/or a venturi effect created by the initial fluid flow between bottom surface 172 and thrust surface 55. Consequently, discharge pressure occupies the space between bottom wall 164 and top surface 170. From the foregoing, it will be appreciated that discharge pressure acting on top surface 170 and inner surface 166 of seal element 158 creates a force distribution on the seal element that urges it axially downwardly toward thrust surface 55 and radially outwardly toward outer wall 168 to seal thereagainst.

The annular seal element disclosed herein is preferably composed of a Teflon material. More specifically, a glassfilled Teflon, or a mixture of Teflon, Carbon, and Ryton is preferred in order to provide the seal element with the necessary rigidity to resist extruding into clearances due to pressure differentials. The materials indicated above are only examples and any other conventional materials could be used. Furthermore, the surfaces against which the Teflon seal contacts could be cast iron or other conventional materials.

Figure 9:
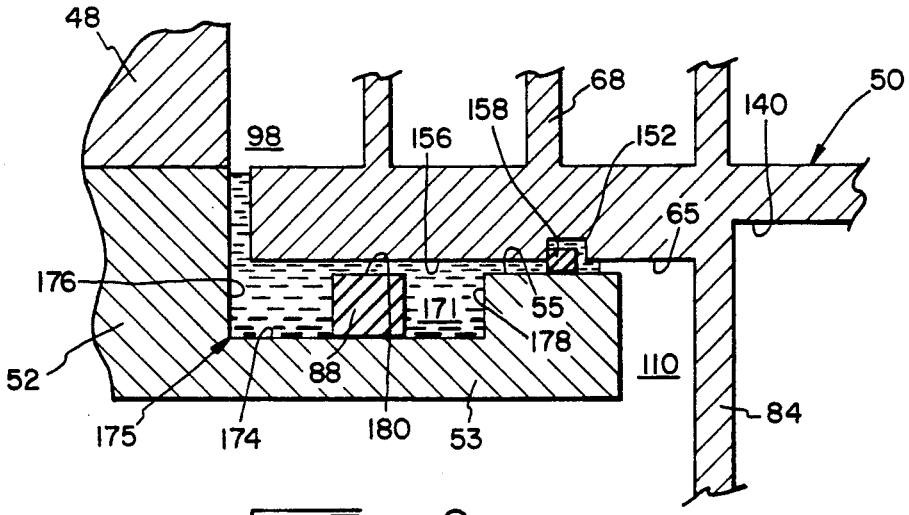
FIG. 9 is an enlarged fragmentary sectional view of the compliance mechanism of FIG. 3, particularly showing the outer flange of the orbiting scroll member and the oil pool therebeneath.

As previously described, the axial compliance mechanism in accordance with the present invention is characterized by a second reactionary force applied to the orbiting scroll member in response to rotating inclined and wobbling motion thereof. This is accomplished by providing an oil pool 171 ad3acent the radially outer portion 156 of back surface 65 of orbiting scroll member 50, as shown in FIGS. 3 and 9. More specifically with reference to FIG. 9, fixed scroll member 52 defines an annular oil chamber 175 having a bottom surface 174, an outer sidewall 176, and an inner sidewall 178 rising from bottom surface 174 to meet thrust surface 55. Oil pool 171 extends above the lower peripheral edge 50*a* of orbiting scroll 50 (FIG. 3).

Figure 10:
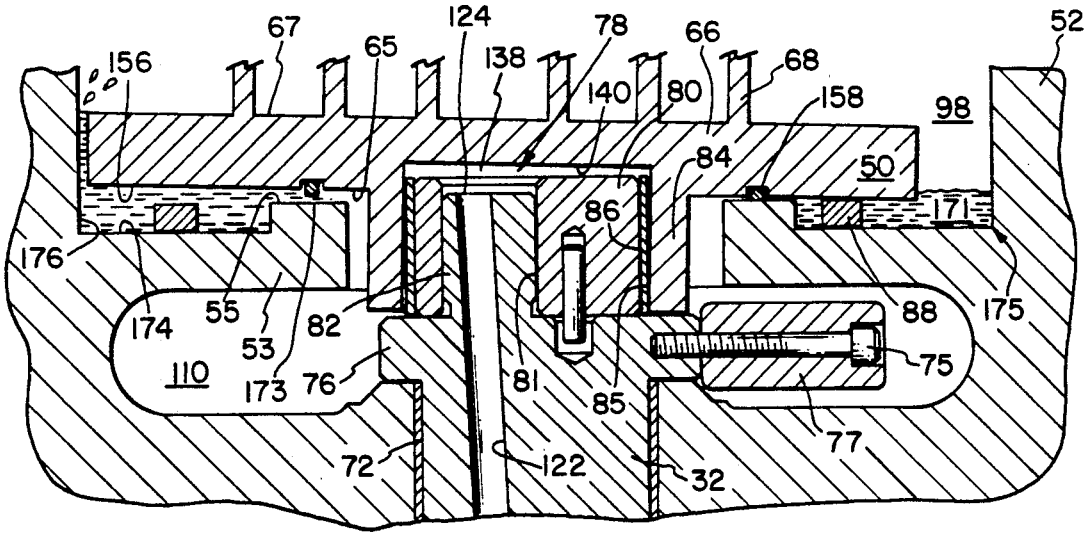
FIG. 10 is a sectional view similar to FIG. 3 showing the inclined orbiting scroll in greatly exaggerated fashion.

In reference to FIG. 10, the inclined orientation of orbiting scroll member 50 is shown. The tilting motion is caused by an overturning moment resulting from forces acting on the orbiting scroll 50 and fixed scroll 52 The wedge-shaped pool of oil 171 is shown on the left side of FIG. 10. It should be noted that seal 158 is lifted slightly off thrust surface 55, thereby producing a widened gap 173 that permits oil to be pumped radially outwardly into wedge-shaped oil pool 171, thereby providing an increased force against the wobbling/tilting perturbations of orbiting scroll 50. It should be noted that the illustration of the inclination of orbiting scroll 50 in FIG. 10 is greatly exaggerated in order to illustrate the principles involved As mentioned earlier, the rotating inclined motion of the orbiting scroll member will cause a rotating leak to occur between seal 158 and thrust surface 55, thereby pumping additional oil into the wedgeshaped oil pool 171 (FIG. 10).

Radially outer portion 156 of back surface 65 orbits above bottom surface 174 of oil chamber 175 in spaced relationship therewith. Oil pool 171 is shown having sufficient depth in oil chamber 175 to fill the space between bottom surface 174 and radially outer portion 156 of back surface 65. In this manner, rotating inclined wobbling motion of the orbiting scroll member results in an attempt to decrease the aforementioned space and thereby compress oil pool 171, which attempt is met by a reaction force exerted by the wedge-shaped oil pool on the back surface of the orbiting scroll member Oil is initially delivered to oil chamber 175 in order to establish oil pool 171, by development of a differential pressure across an initially underlubricated seal element 158 Referring once again to FIG. 3 and the previous discussion relating to the lubrication system of the present invention, oil that flows downwardly along the interface between roller 80 and sleeve bearing 86, and along the interface between bore 81 and crankpin, moves radially outwardly along the top surface of thrust plate 76 and is broadcast by interaction with rotating counterweight 77. This broadcasting action, along with any leakage past seal element 158, causes the oil to move upwardly along the annular space intermediate opening 79 and hub portion 84 and then radially outwardly to seal element 158. Initially, a relatively high rate of leakage past the seal element causes establishment of oil pool 171, which is maintained thereafter by minimal flow of oil past the seal element.

It will be appreciated that oil pool 171 is located within suction pressure chamber 98; however, the reaction force exerted by the oil pool on the orbiting scroll member in response to rotating inclined wobbling motion thereof is independent of ambient pressure level. Furthermore, application of the reactionary impulse force at a radially outermost portion of the orbiting scroll member results in the largest moment and, hence, the maximum benefit for resisting rotating inclined wobbling motion. Accordingly, the diameter of the back surface 156 must be sufficiently large to react with the oil pool 171 to dampen the inclined wobbling motion of orbiting scroll 50. At the same time, the first constantly applied axial compliance force need not be made excessively large in order to compensate for rotating inclined wobbling motion. Rather, the net force applied by the combination of discharge pressure and suction pressure on the back surface of the orbiting scroll member need only be great enough to resist the separating forces and moments produced in the compression pockets.

In the disclosed embodiment, Oldham ring 88 is disposed within oil chamber 175, thereby interacting with oil pool 171 during orbiting motion of the orbiting scroll member 50. It is believed that the placement of Oldham ring 88 within oil pool 71 and the agitation of the oil results in hydraulic forces being applied to back surface 65 of orbiting scroll member 50 that would not exist in its absence. Specifically, the Oldham ring experiences reciprocating motion relative back surface 65 and bottom surface 174, thereby causing localized hydraulic pressurization of the oil at the boundaries of the Oldham ring as the Oldham ring acts as a squeegee against the inertial forces of the oil. It is believed that this dynamic action causes an additional localized axial force on the orbiting scroll member to further enhance axial sealing.

In a 40,000 BTU embodiment of the invention, for example, the outer diameter of thrust surface 55 is 3.48 in., the outer diameter of the flange portion of orbiting scroll 50 is 4.88 in., the average depth of oil pool 171 is 0.22 in., the oil viscosity is 100-300 SUS, and the overturning moment arm (½ the wrap height to the midpoint of bearing 86) is 1.172 in. The clearance of the outer edge of orbiting scroll member 50 to sidewall 176 of the oil chamber (FIG. 9) is preferably in the range of 0.001 in. to 0.100 in., for example 0.025 in., in an exemplary embodiment. Depending on the design compression ratio, operating pressure conditions and scroll and seal gemoetry, these dimensions may change.

It will be appreciated that the foregoing description of one embodiment of the invention is presented by way of illustration only and not by way of any limitation, and that various alternatives and modifications may be made to the illustrated embodiment without departing from the spirit and scope of the invention.

What is claimed is:

1. A scroll-type compressor for compressing refrigerant fluid, comprising:

a hermetically sealed housing including therein a discharge chamber at discharge pressure and a suction chamber at suction pressure;

a fixed scroll member in said housing including an involute fixed wrap element;

an orbiting scroll member in said housing including a plate portion having a face surface and a back surface, said face surface having an involute orbiting wrap element thereon intermeshed with said fixed wrap element, said orbiting scroll member plate portion having a flange extending radially beyond said orbiting wrap element, said flange including a lower peripheral edge;

a thrust surface adjacent said orbiting scroll member back surface, said flange being disposed radially outwardly of said thrust surface;

seal means between said orbiting scroll member and said thrust surface for sealingly separating between respective portions of said plate portion back surface exposed to discharge pressure and suction pressure;

drive means for causing said orbiting scroll member to orbit relative to said fixed scroll member, said orbiting scroll member having a limited degree of freedom of movement in the axial direction sufficient to permit the orbiting scroll member to undergo wobbling inclined motion;

means defining an oil chamber in which said orbiting scroll member flange orbits, said oil chamber having a bottom surface is facing relationship to said orbiting scroll back surface and a sidewall, said chamber being substantially at suction pressure; and means forming a pool of oil in said oil chamber of sufficient depth to function as a hydraulic thrust resistance to said orbiting scroll member flange to thereby counteract downward movement of said flange caused by the wobbling inclined motion of said orbiting scroll member, said oil pool extending above the lower peripheral edge of said orbiting scroll flange.

2. The compressor of claim 1 wherein said pool of oil is wedge-shaped due to an inclined orientation of said flange caused by overturning moments acting on said orbiting scroll member.

3. The compressor of claim 1 wherein said drive means and said means forming a pool of oil include an Oldham mechanism in said oil chamber.

4. The compressor of claim 1 wherein said means forming a pool of oil includes an Oldham means in said oil chamber for constraining said orbiting scroll member to orbital motion, said Oldham means reciprocating in said oil chamber and agitating the oil in the oil pool to create hydraulic pressure against the back surface of said orbiting scroll member plate portion in the area of said flange.

5. The compressor of claim 4 wherein said Oldham means includes a reciprocating annular member that is disposed within the oil pool and has an upper surface in close proximity to but spaced from said plate portion back surface.

6. The compressor of claim 4 wherein said thrust surface forms a shoulder that extends upwardly relative to the bottom surface of said oil chamber, and the oil pool is confined by said thrust surface shoulder and said chamber sidewall.

7. The compressor of claim 4 wherein said orbiting scroll flange is in close proximity to said oil chamber sidewall as it orbits.

8. The compressor claim 7 wherein the minimum clearance of said flange to said oil chamber sidewall throughout a full orbit of said orbiting scroll member is in the range of 0.001 in. to 0.100 in.

9. The compressor of claim 1 wherein said thrust surface forms a shoulder that extends upwardly relative to the bottom surface of said oil chamber, the oil pool is confined by said thrust surface shoulder and said chamber sidewall, the outer diameter of said flange and the outer diameter of said shoulder are generally circular, and the ratio of the outer diameter of said flange to the outer diameter of said shoulder is in the range of 0.001 in. to 0.100 in.

10. The compressor of claim 1 wherein the oil pool has a depth greater than about 0.010 in.

11. The compressor of claim 1 wherein said pool of oil is wedge-shaped due to an inclined orientation of said flange caused by overturning moments acting on said orbiting scroll member, said inclined orbiting scroll member producing a rotating widened gap between said seal means and said thrust surface for pumping an increased amount of oil into said wedge-shaped pool as said orbiting scroll member orbits.

12. A scroll-type compressor for compressing refrigerant fluid, comprising:

a hermetically sealed housing including therein a discharge pressure chamber at discharge pressure and a suction chamber at suction pressure;

a fixed scroll member in said housing including an involute wrap element;

an orbiting scroll member including a plate portion having a face surface and a back surface, said face surface having an involute orbiting wrap element thereon intermeshed with said fixed wrap element, said orbiting scroll member plate portion having a flange extending radially beyond said orbiting wrap element, said flange including a lower peripheral edge;

a thrust surface adjacent said orbiting scroll member back surface, said flange being disposed radially outwardly of said thrust surface;

seal means between said orbiting scroll member and said thrust surface for sealingly separating between respective portions of said plate portion back surface exposed to discharge pressure and suction pressure;

drive means for causing said orbiting scroll member to orbit relative to said fixed scroll member, said orbiting scroll member having a limited degree of freedom of movement in the axial direction sufficient to permit the orbiting scroll member to undergo wobbling inclined motion, means defining an oil chamber in which said orbiting scroll member flange orbits, said oil chamber having a bottom surface in facing relationship to said orbiting scroll back surface and a sidewall, said chamber being substantially at suction pressure; and means for pumping oil to said oil chamber and maintaining a pool of oil in said oil chamber of sufficient depth to function as a hydraulic thrust resistance to said orbiting scroll member flange to thereby counteract downward movement of said flange caused by wobbling inclined motion of said orbiting scroll member, said orbiting scroll flange sweeping through a circular path having a diameter substantially as large as the diameter of said oil chamber, said oil pool extending above the lower peripheral edge of said orbiting scroll flange.

13. The compressor of claim 12 wherein the oil pool is located radially outwardly of said seal means, said drive means includes a crankshaft and a counterweight means attached to said drive shaft, said counterweight means pumping oil upwardly toward said seal means, whereupon a portion of the pumped oil flows across said seal means and collects in said oil pool chamber to form the oil pool.

14. The compressor of claim 13 wherein the oil flowing across said seal means is at substantially discharge pressure.

15. The compressor of claim 13 wherein said means forming a pool of oil includes an Oldham means in said oil chamber for constraining said orbiting scroll member to orbital motion, said Oldham means reciprocating in said oil chamber and agitating the oil in the oil pool to create hydraulic pressure against the back surface of said orbiting scroll member plate portion in the area of said flange.

16. The compressor of claim 13 including:

axial compliance means for exerting refrigerant fluid pressure on said orbiting scroll plate back surface to axially press said scroll members together; and radial compliance means comprising a swing link mechanism for urging said fixed and orbiting scroll members into radial compliance.

17. The compressor of claim 12 wherein said means forming a pool of oil includes an Oldham means in said oil chamber for constraining said orbiting scroll member to orbital motion, said Oldham means reciprocating in said oil chamber and displacing the oil in the oil pool to create hydraulic pressure against the back surface of said orbiting scroll member plate portion in the area of said flange.

18. The compressor of claim 12 including:

axial compliance means for exerting refrigerant fluid pressure on said orbiting scroll plate back surface to axially press said scroll members together; and radial compliance means comprising a swing link mechanism for urging said fixed and orbiting scroll members into radial compliance.

19. The compressor of claim 12 wherein said pool of oil is wedge-shaped due to an inclined orientation of said flange caused by overturning moments acting on said orbiting scroll member.

20. The compressor of claim 12 wherein said pool of oil is wedge-shaped due to an inclined orientation of said flange caused by overturning moments acting on said orbiting scroll member, said inclined orbiting scroll member producing a rotating widened gap between said seal means and said thrust surface for pumping an increased amount of oil into said wedge-shaped pool as said orbiting scroll member orbits.

21. A scroll-type compressor for compressing refrigerant fluid comprising:

a hermetically sealed housing including therein a discharge pressure chamber at discharge pressure and a suction chamber at suction pressure;

a fixed scroll member in said housing including an involute wrap element;

an orbiting scroll member in said housing including a plate portion having a face surface and a back surface, said face surface having an involute orbiting wrap element thereon intermeshed with said fixed wrap element, said orbiting scroll member plate portion having a peripheral flange, said flange including a lower peripheral edge;

a frame having a thrust surface adjacent said orbiting scroll member back surface, said flange being disposed radially outwardly beyond said thrust surface;

drive means for causing said orbiting scroll member to orbit relative to said fixed scroll member, said orbiting scroll member having a limited degree of freedom of movement in the axial direction sufficient to permit the orbiting scroll member to undergo wobbling inclined motion;

axial compliance means including seal means between said orbiting scroll member and said thrust surface for sealingly separating between respective portions of said plate portion back surface exposed to discharge pressure and suction pressure, whereby refrigerant fluid at discharge pressure acts against the back surface of said orbiting scroll plate portion to press said orbiting and fixed scroll members together;

radial compliance means comprising a swing link mechanism for urging said fixed and orbiting scroll members into radial compliance;

means defining an oil chamber in which said orbiting scroll member flange orbits, said oil chamber having a bottom surface in facing relationship to said orbiting scroll back surface and a sidewall, said chamber being substantially at suction pressure; and means forming a wedge-shaped pool of oil in said oil chamber of sufficient depth to function as a hydrodynamic thrust resistance to said orbiting scroll member flange to thereby counteract downward separating movement of said flange caused by inclined wobbling of said orbiting scroll member, said means forming the oil pool including said oil chamber sidewall, and an Oldham means in said oil chamber, said Oldham means reciprocating in said oil chamber and agitating the oil in the oil pool to create hydraulic pressure against the back surface of said orbiting scroll member plate portion in the area of said flange, said oil pool extending above the lower peripheral edge of said orbiting scroll flange.

22. The compressor of claim 21 wherien said Oldham means includes a generally annular reciprocating ring having an upper surface that is spaced from the back surface of said orbiting scroll member and causes oil to flow around said reciprocating ring into contact with said orbiting scroll member back surface as said ring reciprocates.

23. In a hermetic scroll-type compressor including a housing having a discharge pressure chamber at discharge pressure and a suction pressure chamber at suction pressure, fixed and orbiting scroll members within the housing having respective wraps that are operably intermeshed to define compression pockets therebetween, drive means coupled to the orbiting scroll member at a location spaced axially from the intermeshed wraps for causing the orbiting scroll member to orbit relative the fixed scroll member, said orbiting scroll member having a limited degree of freedom of movement in the axial direction sufficient to permit the orbiting scroll member to undergo wobbling inclined motion, and axial compliance means for exposing a radially inner portion of a back surface of the orbiting scroll member to the discharge pressure chamber and a radially outer portion of the back surface to the suction pressure chamber to exert an axial force on the orbiting scroll member toward the fixed scroll member, said orbiting scroll member radially outer portion having a lower peripheral edge, wherein the drive means exerts a drive force on the orbiting scroll member at a location spaced axially from the intermeshed wraps, thereby causing the orbiting scroll member to experience an overturning moment that results in a rotating inclined motion of the orbiting scroll member, oil pool means for applying a reaction force to the radially outer portion of the back surface in response to rotating inclined wobbling motion of the orbiting scroll member to thereby lessen the inclinated wobbling motion and improve sealing between the fixed and orbiting scroll members, said oil pool means including an annular oil chamber having a bottom surface above which the radially outer portion of the back surface of the orbiting scroll member orbits in spaced relationship therewith, and oil within said oil chamber having necessary depth to substantially fill the space between the bottom surface of the oil chamber and the back surface of the orbiting scroll member and extend above the lower peripheral edge of said orbiting scroll member, thereby permitting application of a reaction force to the back surface by the oil when the orbiting scroll member inclines and wobbles so as to alter the space between the bottom surface and the back surface.

24. In a hermetic scroll-type compressor including a housing having a discharge pressure chamber at discharge pressure and a suction pressure chamber at suction pressure, fixed and orbiting scroll members within the housing having respective wraps that are operably intermeshed to define compression pockets therebetween, drive means coupled to the orbiting scroll member at a location spaced axially from the intermeshed wraps for causing the orbiting scroll member to orbit relative to the fixed scroll member, said orbiting scroll member having a limited degree of freedom of movement in the axial direction sufficient to permit the orbiting scroll member to undergo wobbling inclined motion, and axial compliance means for exposing a radially inner portion of a back surface of the orbiting scroll member to the discharge pressure chamber and a radially outer portion of the back surface to the suction pressure chamber to exert an axial force on the orbiting scroll member toward the fixed scroll member, said orbiting scroll member having a lower peripheral edge, wherein the drive means exerts a drive force on the orbiting scroll member at a location spaced axially from the intermeshed wraps, thereby causing the orbiting scroll member to experience an overturning moment that results in a rotationg inclined motion of the orbiting scroll member, oil pool means for applying a reaction to the radially outer portion of the back surface in response to rotating inclined wobbling motion of the orbiting scroll member to thereby lessen the inclined wobbling motion and improve sealing between the fixed and orbiting scroll members, said oil pool means including an annular oil chamber having a bottom surface above which the radially outer portion of the back surface of the orbiting scroll member orbits in spaced relationship therewith, and oil within said oil chamber having necessary depth between the bottom surface of the oil chamber and the back surface of the orbiting scroll member and extending above the lower peripheral edge to thereby permit application of a reaction force to the back surface by the oil when the orbiting scroll member inclines and wobbles so as to alter the space between the bottom surface and the back surface.

* * * * *